US009532601B2

(12) United States Patent
Liu

(10) Patent No.: US 9,532,601 B2
(45) **Date of Patent: *Jan. 3, 2017**

(54) ELECTRONIC CIGARETTE ADOPTING ORGANIC COTTON

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 869 days.

This patent is subject to a terminal disclaimer.

(21) Appl. No.: 13/994,706

(22) PCT Filed: Feb. 1, 2013

(86) PCT No.: PCT/CN2013/071285

§ 371 (c)(1),
(2) Date: Jun. 14, 2013

(87) PCT Pub. No.: WO2014/110847

PCT Pub. Date: Jul. 24, 2014

(65) Prior Publication Data

US 2014/0196717 A1 Jul. 17, 2014

(30) Foreign Application Priority Data

Jan. 15, 2013 (WO) ..... PCT/CN2013/070488

(51) Int. Cl.
*A24F 13/00* (2006.01)
*A24F 17/00* (2006.01)
*A24F 25/00* (2006.01)
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

2012/0145169 A1* 6/2012 Wu ..... A24F 47/008 131/273

* cited by examiner

*Primary Examiner* — Michael H Wilson
*Assistant Examiner* — Phu Nguyen
(74) *Attorney, Agent, or Firm* — Cheng-Ju Chiang

(57) ABSTRACT

An electronic cigarette adopting organic cotton includes a liquid storage component and an atomizing device, the atomizing device includes a hollow spiral heating wire, a liquid guiding member inserted in the heating wire, the liquid guiding member is made of non-fiberglass organic cotton materials; the atomizing device further includes a smog conduit inserted in the liquid storage component for supporting the liquid storage component and serving as a channel for the smog, the smog conduit comprises an outer sleeve and an inner sleeve, one inserted into another to position the liquid guiding member therebetween, and the liquid guiding member has its opposite ends respectively to be protruded out of an outer sidewall of the smog conduit and firmly abut against an inner sidewall of the liquid storage component. This kind of electronic cigarettes is harmless to the human body and has stable and reliable inner structure.

9 Claims, 9 Drawing Sheets

ELECTRONIC CIGARETTE ADOPTING ORGANIC COTTON

CROSS REFERENCE TO RELATED APPLICATIONS

The present application is a 35 U.S.C. §371 National Phase conversion of International (PCT) Patent Application No. PCT/CN2013/071285, filed on Feb. 1, 2013, the disclosure of which is incorporated by reference herein. The PCT International Patent Application was filed in Chinese.

TECHNICAL FIELD

This invention relates to a field of electronic cigarettes, and particularly to an electronic cigarette having a liquid guiding member made of organic cotton.

DESCRIPTION OF BACKGROUND

Current electronic cigarettes are configured therein with a liquid storage component for accommodating liquid smoke, an atomizing device for transforming the liquid smoke in the liquid storage component into smog and a power supply apparatus to supply power to the atomizing device, the atomizing device is mainly constituted by a heating wire, a liquid guiding member and a smog conduit with a through hole for the smog to circulate, the liquid guiding member and the smog conduit both are made of silica-based fiberglass materials, the fiberglass belongs to inorganic cotton, and the heating wire is wound around the liquid guiding member, with its opposite ends connected with conductive wires, then the heating wire is transversely placed into the smog conduit, exposed ends of the conductive wires are connected with the positive and negative electrodes of the power supply apparatus, the liquid guiding member and the liquid storage component are connected to absorb the liquid smoke, finally the liquid smoke is transported to the heating wire through the liquid guiding member, the heating wire after energized would atomize the liquid smoke to generate smog. Since the liquid guiding member and the smog conduit in the atomizing device are made of inorganic cotton, which is formed by numerous intertwined tiny fiberglass yarn, and they are prone to be broken, bent, and twisted. When the heating wire is wound around the liquid guiding member of fixed in the smog conduit, the liquid conduit or the smog conduit are easy to be bent or twisted, and this process would generate countless fiberglass flocs which adhere to the liquid guiding member and the heating wire and inner wall of the smog conduit, and easy to enter the mouth, respiratory tract or lung during smoking the assembled electronic cigarette, thereby causing serious harm to the human body. In addition, the smog conduit made of fiberglass material is easy to be broken, bent and twisted, and has poor structural stability and reliability.

SUMMARY

An object of the present invention is to provide an electronic cigarette adopting organic cotton, which is safe and harmless to the human body and has stable and reliable inner structure.

To resolve the above problem, the present invention provides electronic cigarette adopting organic cotton, comprising a tubular liquid storage component for storing liquid smoke, an atomizing device for atomizing the liquid smoke in the liquid storage component into smog, the atomizing device comprises a hollow spiral heating wire, a liquid guiding member inserted in the heating wire to support the heating wire and absorb and reserve the liquid smoke for the heating wire to atomize it, wherein, the liquid guiding member is made of non-fiberglass organic cotton materials; the atomizing device further comprises a smog conduit inserted in the liquid storage component for supporting the liquid storage component and serving as a channel for the smog, the smog conduit comprises an outer sleeve and an inner sleeve, one inserted into another to position the liquid guiding member therebetween and provide a space for the heating wire to work, and the liquid guiding member has its opposite ends respectively to be protruded out of an outer sidewall of the smog conduit and firmly abut against an inner sidewall of the liquid storage component; the atomizing device is further configured with an atomizing seat disposed at an inner wall of the electronic cigarette for supporting and positioning the smog conduit and a substrate for supporting the atomizing seat.

Wherein, the inner sleeve is a part of the atomizing seat, the inner sleeve is a cylinder with its one end opened and another end terminated by a bottom wall thereof, the atomizing seat is further configured with an inserting post axially outwardly extended from the bottom wall of the inner sleeve; the substrate is configured with a positioning post therein for insertedly engaging with the inserting post.

Wherein, the inserting post defines a first through hole coaxially extended therethrough, the inner sleeve defines a second through hole therein axially extended therethrough and communicated with the first through hole, the inner sleeve defines a first locking slot at its one end which is far away from the inserting post to mount the liquid guiding member; the first locking slot is an opened slot radially extended through a sidewall of the inner sleeve and including a notch at an end portion of the inner sleeve.

Wherein, the inner sleeve defines perforations axially extended through its bottom wall at an edge thereof which is located at an outer side of the inserting post for penetration of leading the heating wire.

Wherein, the substrate is cup-shaped, and comprises a sidewall, a bottom wall and an inner chamber encircled by its sidewall and bottom wall, the bottom wall of the substrate defines a vent hole axially extended therethrough.

Wherein, the positioning post is a cylindrical component axially upwardly extended from the bottom wall of the substrate, and the positioning post is communicated with the vent hole.

Wherein, the bottom wall of the substrate further defines perforations axially extended therethrough at an outside of the positioning post.

Wherein, the sidewall of the substrate is further configured with expanding rings at its bottom for tightly engaging with the inner wall of the electronic cigarette by expansion, the substrate is tightly positioned to the inner wall of the electronic cigarette by expansion through the sidewall of the substrate and the expanding rings.

Wherein, the liquid storage component has its one end to be inserted into and tightly engaged by expansion in the inner chamber of the substrate, correspondingly, the liquid storage component has its end insertedly engaged with the substrate to be configured with an inserting portion and a restraining step.

Wherein, the atomizing seat adopts ceramic materials, and the substrate adopts plastic or metal materials.

Adopting the above technical solutions, the electronic cigarette of the present invention has the following beneficial effects: the present invention can not only reduce costs, but also improve production efficiency, and most importantly can prevent the damage to the human body after inhalation of fiberglass flocs, by changing the structure of the atomizing device, and adopting organic cotton materials instead of fiberglass materials for the liquid guiding member, the liquid storage component and the infiltrating component; while the smog conduit made of the plastic, silicone, metal or ceramic materials with higher hardness is used as an alternative of the smog conduit made of fiberglass materials, which can effectively prevent the damage to the human body after the smoker inhales fiberglass flocs. Meanwhile, the smog conduit is constituted by an inner sleeve and a main conduit having an outer sleeve, and the outer sleeve and the inner sleeve are engaged by inserting one into another to mount the liquid guiding member, this makes the liquid guiding member to be stable in its installation and usage, the organic cotton materials can reduce the temperature of the heating wire by its properties of quick liquid-guide, to ensure the reliability of the heating wire during use; in addition, the smog conduit adopting the plastic, silicone, metal or ceramic materials can also ensure the strength thereof, to make the entire electronic cigarette to be stable in its inner structure, and safe and reliable in use.

The embodiments of the present invention are further described in detail as follows in conjunction with the accompanying drawings.

DETAILED DESCRIPTION OF THE EMBODIMENTS

Figure 1:
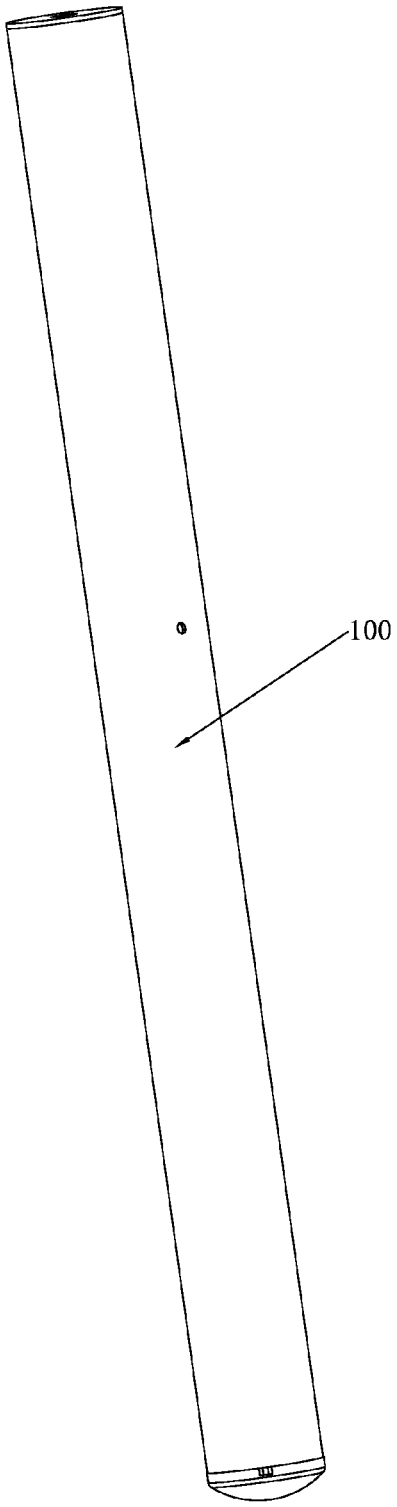
FIG. 1 is an isometric view of an electronic cigarette in accordance with a first embodiment of the present invention.

It should be noted that, the embodiments and the characteristics in the embodiments can be mutually combined in case of no confliction. The present invention would be further described in detail as follows through embodiments in conjunction with the accompanying drawings.

As shown from FIG. 1 to FIG. 7, a first embodiment of the present invention provides an electronic cigarette 100 adopting organic cotton, the electronic cigarette 100 is a one-piece electronic cigarette, and comprises a cylindrical external sheath 1, a liquid storage component 37 configured in the external sheath 1 for accommodating the liquid smoke, an atomizing device 2 for transforming the liquid smoke in the liquid storage component 37 into smog and a power supply apparatus 8 for supplying power to the atomizing device 2, the external sheath 1 has its opposite ends to be configured with a nozzle 41 and a bottom cap respectively as sealing caps of the external sheath 1, and the nozzle 41 and the bottom cap 42 both are configured with a vent hole therein. The electronic cigarette 100 is further configured with a smog conduit therein, as a channel for guiding the smog generated by atomizing the liquid smoke to an outside of the external sheath 1, the smog conduit is capable of being made of non-fiberglass materials, such as: silicone, plastic, ceramic or metal materials. The smog conduit in the first embodiment is constituted by an inner sleeve 241 and a main conduit 35 described hereafter.

Figure 2:
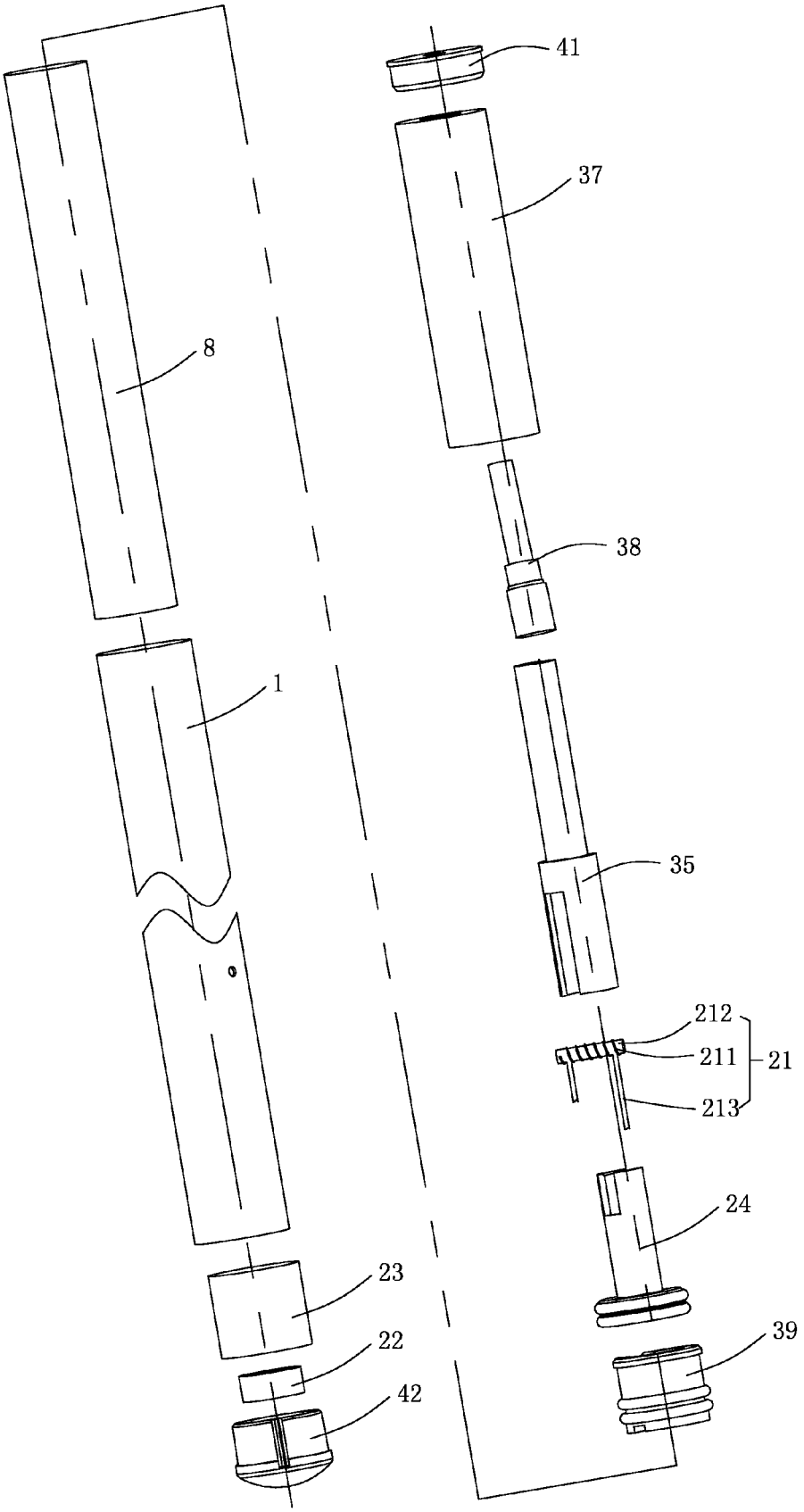
FIG. 2 is an exploded view of the electronic cigarette in accordance with the first embodiment of the present invention.
Figure 3:
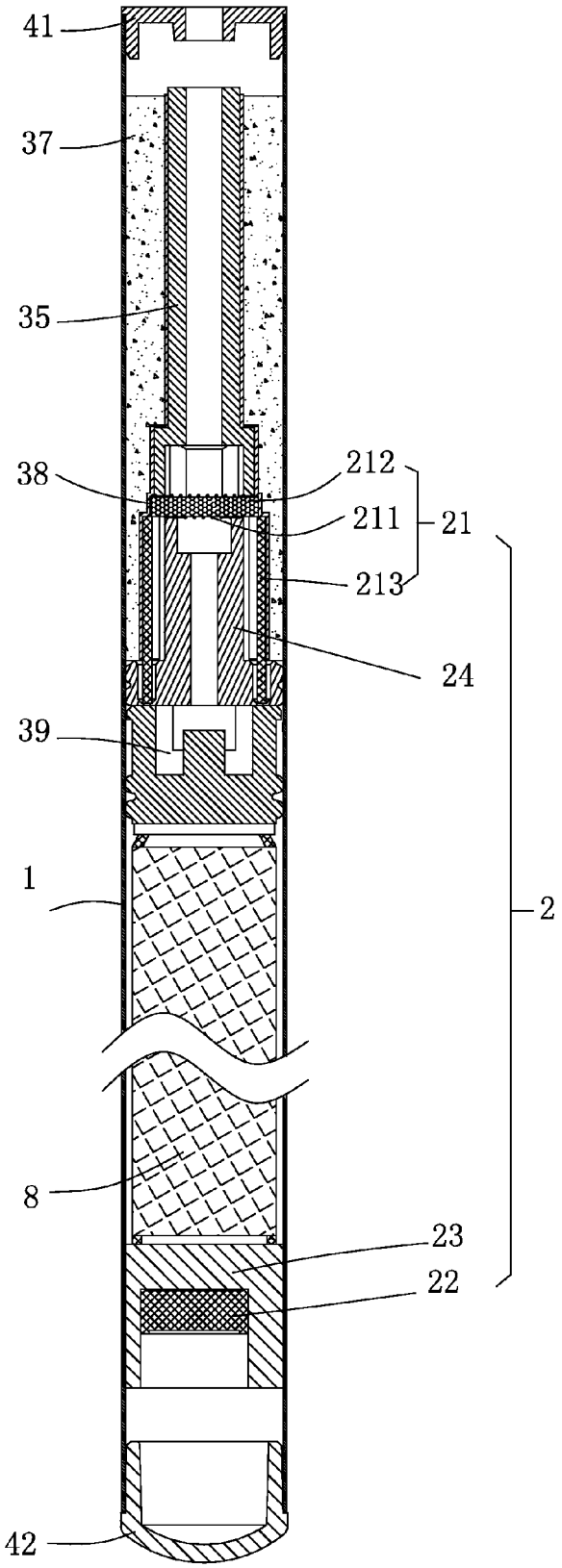
FIG. 3 is a cross-sectional view of the electronic cigarette in accordance with the first embodiment of the present invention.

As shown in FIG. 2 and FIG. 3, the atomizing device 2 comprises an atomizer 21, an atomizing seat 24 for supporting the atomizer 21, an atomizer control circuit board 22 and a circuit board holder 23 for accommodating and positioning the atomizing control circuit board 22, the atomizer control circuit board 22 is configured with a miniature pneumatic switch to control a conduct of circuit to start the atomizer 21. The atomizer 21 is used for transforming the liquid smoke into smog, and comprises a hollow spiral heating wire 211, a liquid guiding member 211 for absorbing the liquid smoke and supporting the heating wire 211 and leading wires 213, the heating wire 211 is wound around the liquid guiding member 212, the liquid guiding member is capable of absorbing and reserving the liquid smoke, the liquid guiding member 212 adopts non-fiberglass material, and is capable of being made of materials having liquid-absorbent and liquid barrier properties such as cotton material, for example any one or any combination of pure cotton, paper material, chemical fiber, or linen thread. In this embodiment, the liquid guiding member 212 is accommodated and positioned in the smog conduit, the heating wire 211 has its opposite ends to be respectively connected with the corresponding one of the leading wires 213, and the leading wires 213 pass through the atomizing seat 24 and then are electrically connected with the positive electrode and the negative electrode of the power supply apparatus 8.

Figure 6:
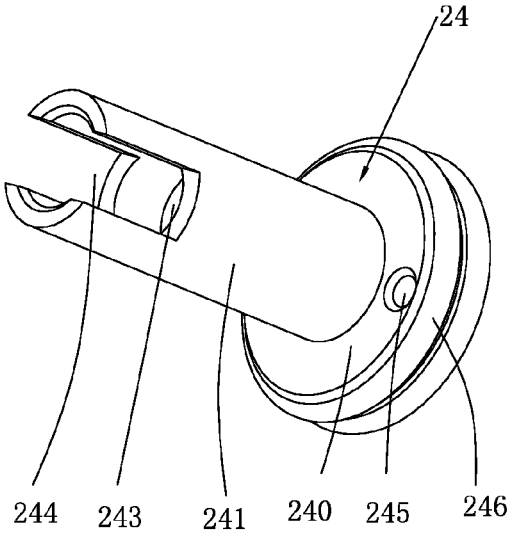
FIG. 6 is an isometric view of an atomizing seat of the electronic cigarette in accordance with the first embodiment of the present invention.
Figure 7:
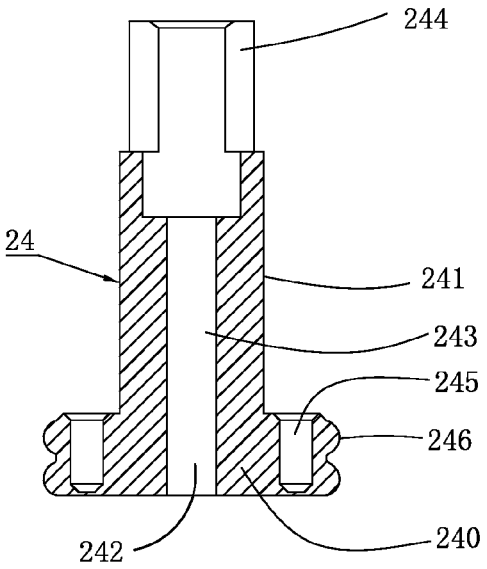
FIG. 7 is a cross-sectional view of the atomizing seat of the electronic cigarette in accordance with the first embodiment of the present invention.
Figure 8:
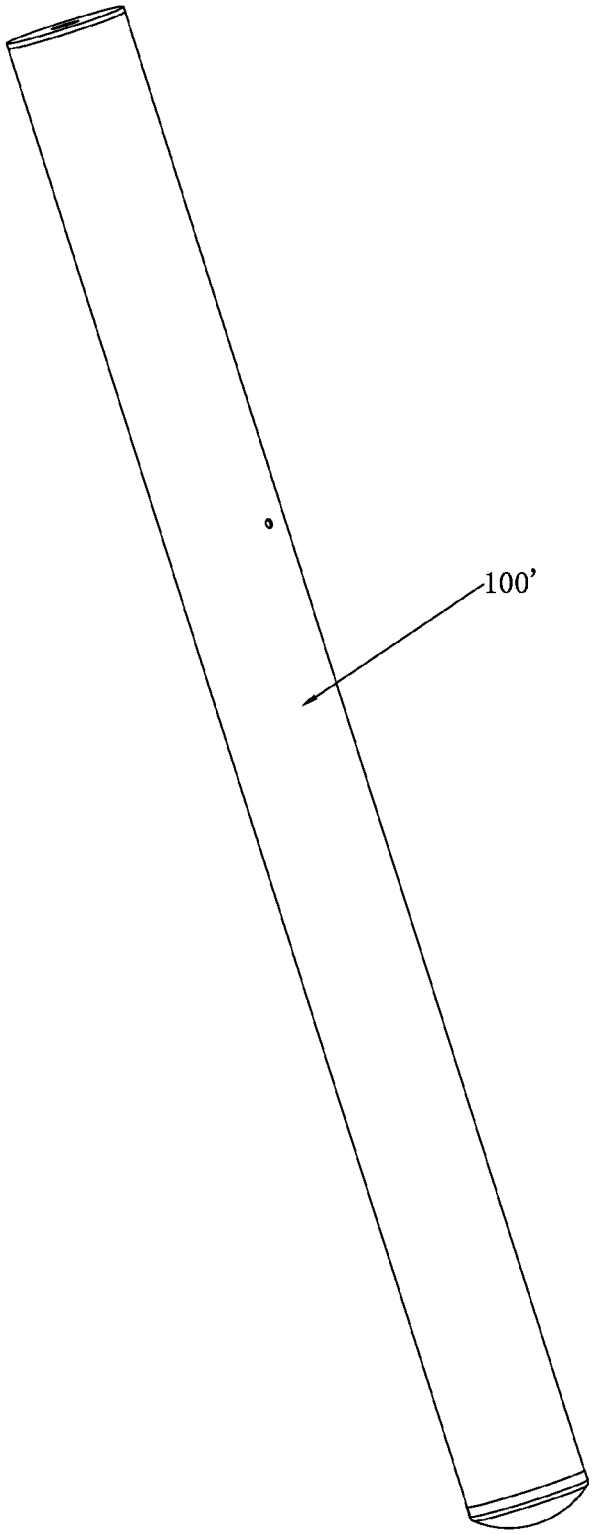
FIG. 8 is an isometric view of an electronic cigarette in accordance with a second embodiment of the present invention.

As shown in FIG. 6 and FIG. 7, the atomizing seat 24 comprises a main body 240 engaged with an inner wall of the external sheath 1 and a tubular inner sleeve 241 extended outwardly along an axial direction of the main body 240, the main body 240 defines a first through hole 242 coaxially extended therethrough, the inner sleeve 241 defines a second through hole 243 therein axially extended therethrough and communicated with the first through hole 242, the inner sleeve 241 is configured with a first locking slot 244 at its one end which is far away from the main body 240, the first locking slot 244 is an opened slot radially extended through a sidewall of the inner sleeve 241 and including a notch at an end portion of the inner sleeve 241, for transversely mounting the liquid guiding member 212, and simultaneously being convenient for the liquid guiding member 212 to pass through the inner sleeve 241 and abut against the liquid storage component 37 so as to absorb the liquid smoke. The main body 240 defines two perforations 245 axially extended through an edge thereof which is located at an outer side of the inner sleeve 241 for penetration of the heating wire 211. The main body 240 is configured with expanding rings 246 at its outer sidewall for tightly engaging with the external sheath 1 by expansion, the atomizing seat 24 is tightly positioned on the inner wall of the external sheath 1 by expansion through its outer sidewall and the expanding rings. The atomizing seat 24 adopts plastic or metal materials, to ensure its strength, without fiberglass flocs generated.

Figure 4:
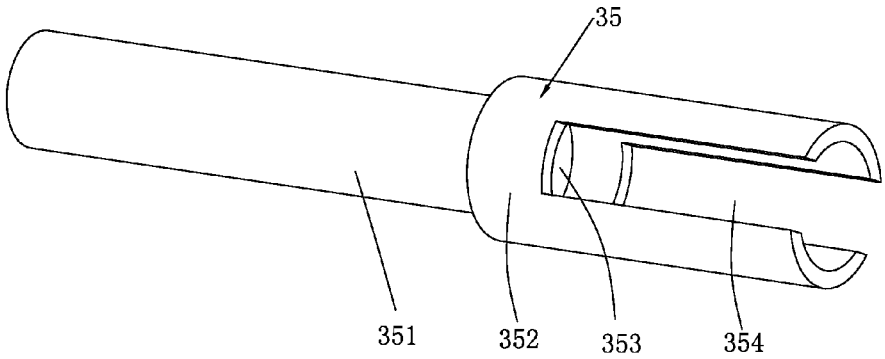
FIG. 4 is an isometric view of a main conduit of the electronic cigarette in accordance with the first embodiment of the present invention.
Figure 5:
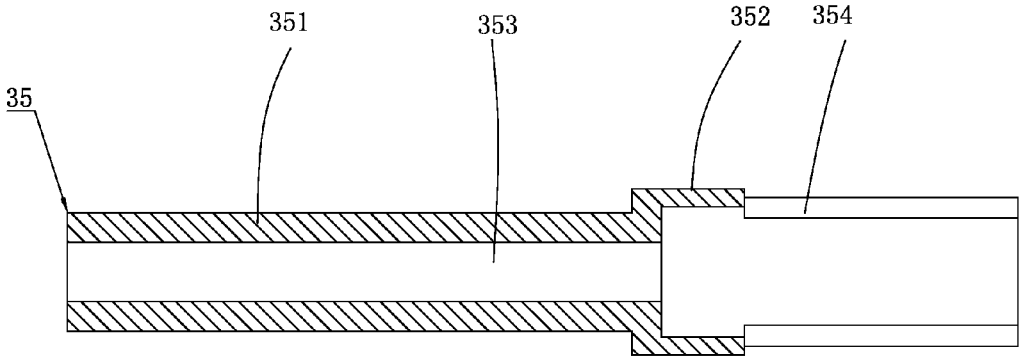
FIG. 5 is a cross-sectional view of the main conduit of the electronic cigarette in accordance with the first embodiment of the present invention.

As shown in FIG. 4 and FIG. 5, the main conduit 35 comprises inter-communicated supporting tube 351 and outer sleeve 352, the supporting tube 351 and the outer sleeve 352 is integrally formed or individually formed, and both of them are configured with a central through hole therein which are inter-communicated to form a vent hole 353 of the main conduit 35. The outer sleeve 352 defines a second locking slot 354 engaged with the first locking slot 244 of the inner sleeve 241, the second locking slot 354 is an opened slot radially extending through an sidewall of the outer sleeve 352 and including a notch at an end portion of the outer sleeve 352. The liquid guiding member 212 mounted in the first locking slot 244 respectively passes through the second locking slot 35 and abuts against the liquid storage component 37 to absorb the liquid smoke for atomization by the heating wire 211.

As shown in FIG. 2 and FIG. 3, the liquid storage component 37 is used for absorbing and reserving the liquid smoke for subsequent atomization of the liquid smoke by the atomizer 2, and is capable of absorbing and reserving the liquid smoke, and can be made of materials having liquid-absorbent and liquid barrier properties such as cotton material. The liquid storage component 37 has a hollow tubular structure, and is sleeved around the main conduit 35 and tightly engaged with an outer wall of the main conduit 35 for support, and has its opposite ends to be respectively inserted into an annular inner chamber of the atomizing seat 24 and an annular inner chamber of the nozzle 41. The liquid storage component 37 has its sidewall to abut against the liquid guiding member 212, and the liquid smoke is infiltrated into the liquid guiding member 212 from the liquid storage component 37 and is atomized into smog by the heating wire 211 after absorbed by the liquid guiding member 212.

As shown in FIG. 2 and FIG. 3, the electronic cigarette 100 is further configured with an infiltrating component 38 therein, the infiltrating component 38 is capable of absorbing and reserving the liquid smoke, and can be made of non-fiberglass materials having liquid-absorbent and liquid barrier properties, such as: organic cotton material, and the organic cotton can be any one or any combination of pure cotton, hard paper, or organic-based chemical fiber or linen thread. The infiltrating component 38 is configured between the liquid storage component 37 and the main conduit 35, the infiltrating component 38 has its outer sidewall to abut against an inner sidewall of the liquid storage component 37 and has its inner sidewall to abut against an outer sidewall of the outer sleeve 352 of the main conduit 35, the infiltrating component 38 is located at an outside of the smog conduit, or sleeved around the smog conduit, so that an inner wall of the infiltrating component 38 is capable of abutting against opposite ends of the liquid guiding member 212 and the liquid guiding member 212 can absorb the liquid smoke which is infiltrated from the liquid storage component 37 to the infiltrating component 38. The infiltrating component 38 has its absorbent capacity slightly greater than that of the liquid storage component 37 so that the liquid smoke can be infiltrated from the liquid storage component 38 to the liquid guiding member 212 faster.

As shown in FIG. 3, in this embodiment, the nozzle 41, the atomizing seat 24, the main conduit 35 and the liquid storage component e37 of the electronic cigarette and further part of a sidewall of the external sheath 1 commonly defines a space for storing the liquid smoke, this space is an equivalent of the liquid smoke cup of a traditional electronic cigarette. Wherein, the atomizing seat 24 and the nozzle 41 are positioned onto the inner wall of the external sheath 1 and opposed and spaced from each other in a certain distance, to restrict the space used to store the liquid smoke; the main conduit 35 is disposed between the atomizing seat 24 and the nozzle 41; the liquid storage component 37 is disposed between the main conduit 35 and the external sheath 1.

As shown in FIG. 2 and FIG. 3, the electronic cigarette 100 is further configured with a liquid separation seat 39 therein to prevent the liquid smoke from leakage, the liquid separation seat 39 is disposed on the inner wall of the external sheath, and located between the atomizing seat 24 and the power supply apparatus 8 to prevent the liquid smoke from leaking out of the atomizing seat 24 to the power supply apparatus 8, the liquid separation seat 39 also defines perforations (not shown) in its bottom wall.

In installation, the liquid guiding member 212 with the heating wire wound there-around is transversely mounted into the first locking slot 244 of the inner sleeve 241 of the atomizing seat 24, the inner sleeve 241 of the atomizing seat 24 is then inserted into the outer sleeve 352 of the main conduit 35, to ensure that the liquid guiding member 212 is positioned in the first locking slot 244 of the inner sleeve 241 with its opposite ends to be protruded out of the second locking slot 354 of the main conduit 35 to firmly abut against the infiltrating component 38. The heating wire 211 has its opposite ends to be respectively connected with the corresponding leading wires 213, and each of the leading wires 213 in turn passes through the perforation 245 of the atomizing seat 24 and the perforation of the liquid separation seat 39 and are connected to the atomizer control circuit board 22, and junctions between the heating wire 212 and the perforations are sealed.

As shown from FIG. 8 to FIG. 14, a second embodiment of the present invention provides an electronic cigarette 100' adopting organic cotton, the electronic cigarette 100' is a one-piece electronic cigarette, and is substantially similar to the electronic cigarette 100 of the first embodiment, the difference thereof is that it comprises an atomizing device 2' and a liquid storage component 37' engaged with the atomizing device 2'. The smog conduit in the second embodiment is constituted by an inner sleeve 241' described hereafter and the above-mentioned main conduit 35.

The atomizing device 2' is substantially similar to the atomizing device 2, and the difference thereof is that that it comprises an atomizing seat 24' and a substrate 25 for supporting the atomizing seat 24'.

Figure 11:
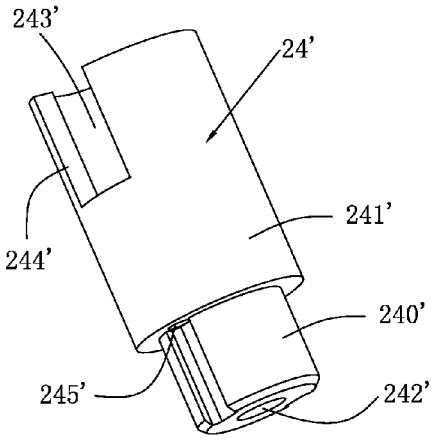
FIG. 11 is an isometric view of an atomizing seat of the electronic cigarette in accordance with the second embodiment of the present invention, from a first perspective.
Figure 12:
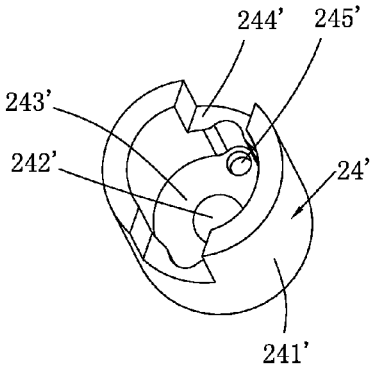
FIG. 12 is an isometric view of the atomizing seat of the electronic cigarette in accordance with the second embodiment of the present invention, from a second perspective.
Figure 13:
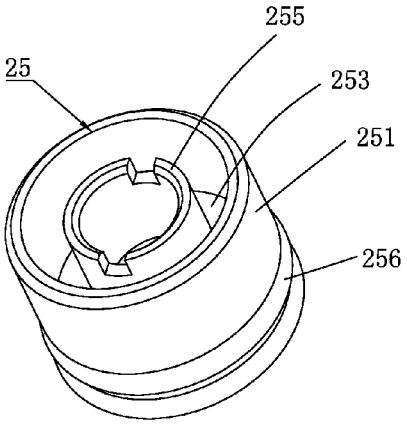
FIG. 13 is an isometric view of a substrate of the electronic cigarette in accordance with the second embodiment of the present invention.
Figure 14:
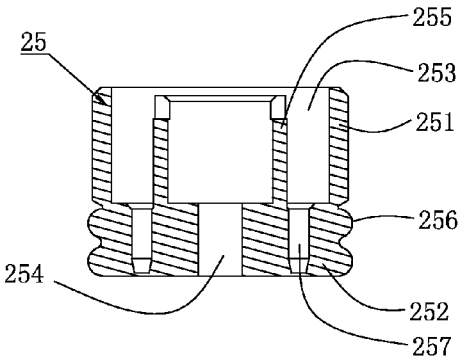
FIG. 14 is a cross-sectional view of the substrate of the electronic cigarette in accordance with the second embodiment of the present invention.

As shown in FIG. 11 and FIG. 12, the atomizing seat 24' comprises an inner sleeve 241' engaged with the inner wall of the external sheath 1 and a cylindrical inserting post 240' axially outwardly extended from a bottom wall of the inner sleeve 241', the inserting post 240' defines a first through hole 242' coaxially extended therethrough, and an outer wall of the inserting post 240' is engaged with the inner wall of the external sheath 1. The inner sleeve 241' is a cylinder having a bottom wall and a sidewall, the inner sleeve 241' defines a second through hole 243' therein axially extended therethrough and communicated with the first through hole 242', the inner sleeve 241' is configured with a first locking slot 244' at its one end which is far away from the inserting post 240', the first locking slot 244' is an opened slot radially extended through an sidewall of the inner sleeve 241' and including a notch at an end portion of the inner sleeve 241', for transversely mounting the liquid guiding member 212, and simultaneously being convenient for the liquid guiding member 212 to pass through the inner sleeve 241' and abut against the liquid storage component 37' so as to absorb the liquid smoke. The inner sleeve 241' defines two perforations 245' axially extended through its bottom wall at an edge thereof which is located at an outer side of the inserting post 240' for penetration of the heating wire 211. In this embodiment, the atomizing seat 24' adopts ceramic materials.

Figure 9:
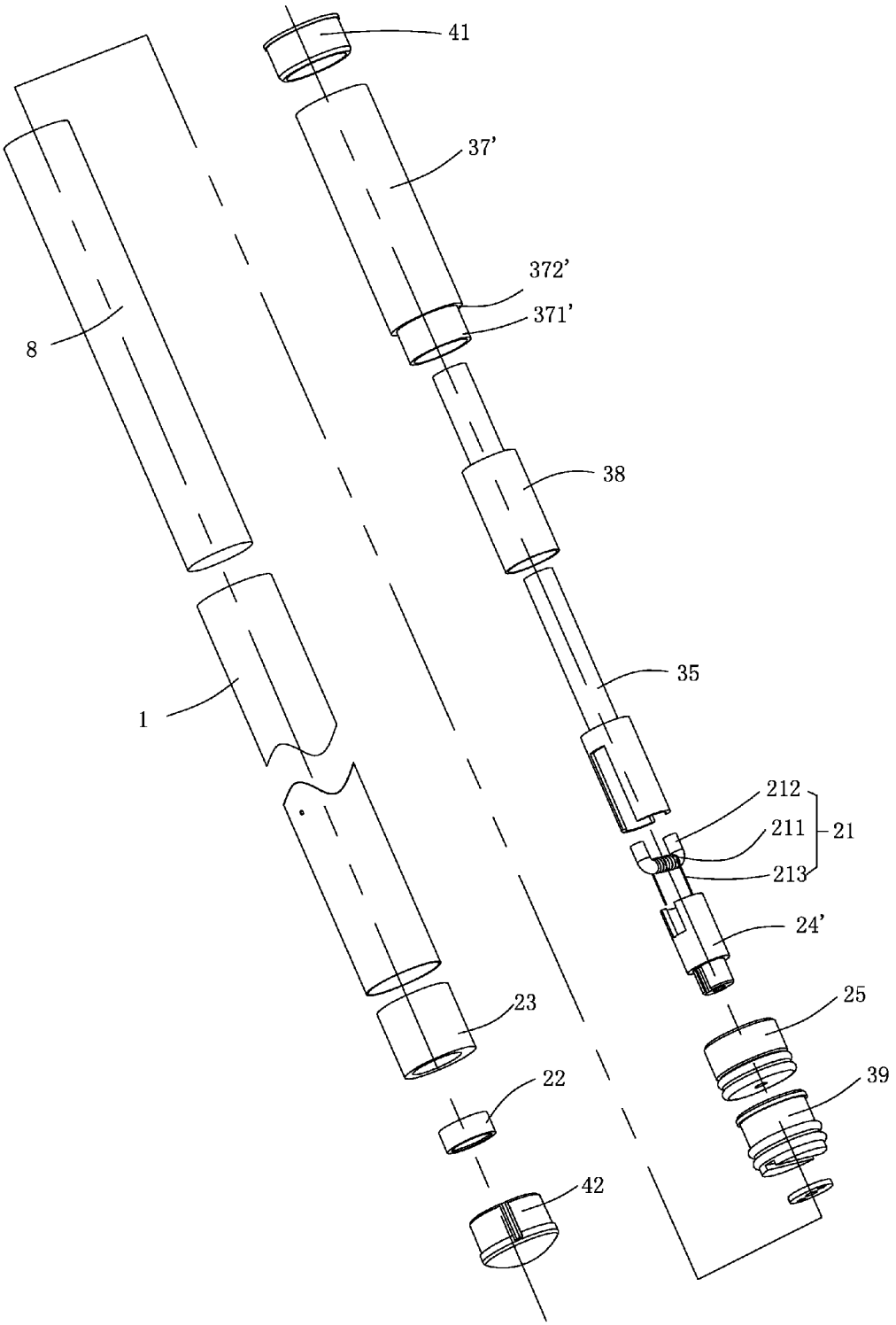
FIG. 9 is an exploded view of the electronic cigarette in accordance with the second embodiment of the present invention.
Figure 10:
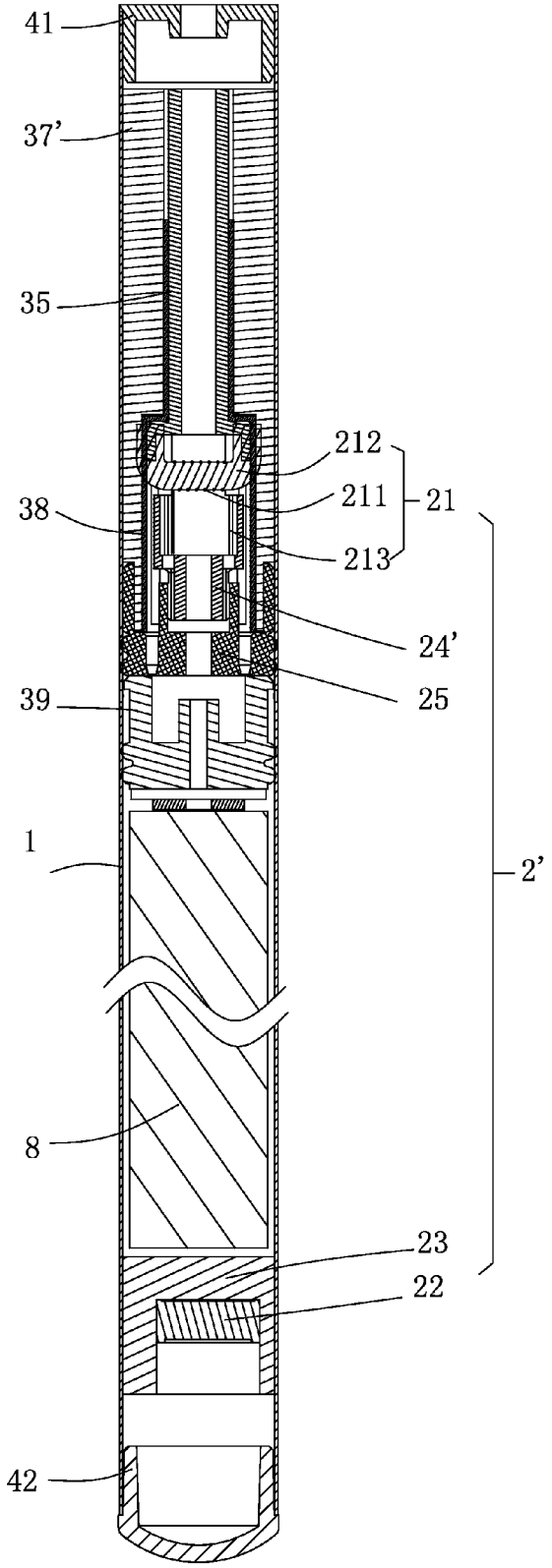
FIG. 10 is a cross-sectional view of the electronic cigarette in accordance with the second embodiment of the present invention.

The substrate 25 is cup-shaped, and comprises a sidewall 251, a bottom wall 252 and an inner chamber 253 encircled by the sidewall and bottom wall thereof, the bottom wall of the substrate defines a vent hole 254 axially extended therethrough, a cylindrical positioning post 255 is configured in the inner chamber 253 and axially upwardly extended from the bottom wall 252 of the substrate, for insertedly engaging with the inserting post 240 to support and position the atomizing seat 24 to the substrate 25, and the positioning post 255 is communicated with the vent hole 254. The bottom wall 252 of the substrate further defines perforations 257 axially extended therethrough at an outside of the positioning post 255. The sidewall 251 of the substrate is further configured with expanding rings 256 at its bottom for tightly engaging with the external sheath 1 by expansion, the substrate 25 is tightly positioned to the inner wall of the external sheath 1 by expansion through the sidewall 251 and the expanding rings 256. The substrate 25 adopts plastic or metal materials, to ensure its strength, without fiberglass flocs generated. The liquid storage component 37' has its one end to be inserted into and tightly engaged by expansion in the inner chamber 253 of the substrate 25. Correspondingly, the liquid storage component 37' has its end insertedly engaged with the substrate 25 to be configured with an inserting portion 371' and a restraining step 372' (as shown in FIG. 9).

The above-described is embodiments of the present invention, it should be noted that, for the persons of ordinary skill in this field, various changes and improvements within the principle and spirit of the present invention can be made, and the changed and improved solutions also fall into the protecting scope of the present invention.

What is claimed is:

1. An electronic cigarette adopting organic cotton, comprising a tubular liquid storage component for storing liquid smoke, an atomizing device for atomizing the liquid smoke in the liquid storage component into smog, the atomizing device comprises a hollow spiral heating wire, a liquid guiding member inserted in the heating wire to support the heating wire and absorb and reserve the liquid smoke for the heating wire to atomize it, wherein, the liquid guiding member is made of non-fiberglass organic cotton materials; the atomizing device further comprises a smog conduit inserted in the liquid storage component for supporting the liquid storage component and serving as a channel for the smog, the smog conduit comprises an outer sleeve and an inner sleeve, one inserted into another to position the liquid guiding member therebetween and provide a space for the heating wire to work, and the liquid guiding member has its opposite ends respectively to be protruded out of an outer sidewall of the smog conduit and firmly abut against an inner sidewall of the liquid storage component; the atomizing device is further configured with an atomizing seat disposed at an inner wall of the electronic cigarette for supporting and positioning the smog conduit and a substrate for supporting the atomizing seat;

said organic cotton is a kind of non-fiberglass materials having liquid-absorbent and liquid barrier properties;

the inner sleeve is a part of the atomizing seat, the inner sleeve is a cylinder with its one end opened and another end terminated by a bottom wall thereof, the atomizing seat is further configured with an inserting post axially outwardly extended from the bottom wall of the inner sleeve; the substrate is configured with a positioning post therein for insertedly engaging with the inserting post.

2. The electronic cigarette as described in claim 1, wherein, the inserting post defines a first through hole coaxially extended therethrough, the inner sleeve defines a second through hole therein axially extended therethrough and communicated with the first through hole, the inner sleeve defines a first locking slot at its one end which is far away from the inserting post to mount the liquid guiding member; the first locking slot is an opened slot radially extended through a sidewall of the inner sleeve and including a notch at an end portion of the inner sleeve.

3. The electronic cigarette as described in claim 1, wherein, the inner sleeve defines perforations axially extended through its bottom wall at an edge thereof which is located at an outer side of the inserting post for penetration of the heating wire.

4. The electronic cigarette as described in claim 1, wherein, the substrate is cup-shaped, and comprises a sidewall, a bottom wall and an inner chamber encircled by its sidewall and bottom wall, the bottom wall of the substrate defines a vent hole axially extended therethrough.

5. The electronic cigarette as described in claim 4, wherein, the positioning post is a cylindrical component axially upwardly extended from the bottom wall of the substrate, and the positioning post is communicated with the vent hole.

6. The electronic cigarette as described in claim 4, wherein, the bottom wall of the substrate further defines perforations axially extended therethrough at an outside of the positioning post.

7. The electronic cigarette as described in claim 4, wherein, the sidewall of the substrate is further configured with expanding rings at its bottom for tightly engaging with the inner wall of the electronic cigarette by expansion, the substrate is tightly positioned to the inner wall of the electronic cigarette by expansion through the sidewall of the substrate and the expanding rings.

8. The electronic cigarette as described in claim 4, wherein, the liquid storage component has its one end to be inserted into and tightly engaged by expansion in the inner chamber of the substrate, correspondingly, the liquid storage component has its end insertedly engaged with the substrate to be configured with an inserting portion and a restraining step.

9. The electronic cigarette as described in claim 1, wherein, the atomizing seat adopts ceramic materials, and the substrate adopts plastic or metal materials.

* * * * *